United States Patent [19]

Rivera

[11] Patent Number: 4,881,305

[45] Date of Patent: Nov. 21, 1989

[54] LOCKING BOX CLASP FOR JEWELRY

[76] Inventor: Jose C. Rivera, 216 S. Dakota, Laredo, Tex. 78041

[21] Appl. No.: 188,285

[22] Filed: Apr. 29, 1988

[51] Int. Cl.[4] ..... A44B 11/25

[52] U.S. Cl. ..... 24/616; 24/618

[58] Field of Search ..... 24/616, 618, 615, 116 A, 24/634, 573, 241 SB, 241 SP; 63/4, 29.1

[56] References Cited

U.S. PATENT DOCUMENTS

| | | | |
|---|---|---|---|
| 468,677 | 2/1892 | Maxheimer et al. | 24/616 |
| 1,631,824 | 6/1927 | Jones | 24/616 |
| 1,807,293 | 5/1931 | Keller | 24/616 |
| 2,513,592 | 7/1950 | Silverman | 24/616 |
| 2,986,792 | 6/1961 | Wyatt | 63/4 |
| 3,844,000 | 10/1974 | Hedu | 24/618 |
| 3,947,932 | 4/1976 | Flynn | 24/618 |
| 3,967,351 | 7/1976 | Rosenberg et al. | 24/616 |
| 4,426,854 | 1/1984 | Geldwerth et al. | 24/616 |
| 4,520,537 | 6/1985 | Valikov | 24/116 A |
| 4,532,682 | 8/1985 | Murao | 24/618 |

*Primary Examiner*—Victor N. Sakran

*Attorney, Agent, or Firm*—Gunn, Lee & Jackson

[57] ABSTRACT

An improved locking box clasp for use with jewelry comprising a generally rectangular box with a top opening, a side opening and front end openings, a clip member and a locking pin. The clip member inserts into the front end of the box, and contains a locking boss on the top side thereof, which locking boss is of dimensions slightly less than the top opening of the box. When the clip member is inserted into the open front end, it must be compressed and the locking boss seats into the top opening. A locking pin, articulating from the rear end of the box, has a tongue which, when inserted into the side opening of the box, prevents unintentional compression of the locking boss of the clip member, and therefore, unintentional removal of the clip member from the box. One end of a jewelry chain is anchored to the clip member, and the second end is anchored to the box.

10 Claims, 2 Drawing Sheets

LOCKING BOX CLASP FOR JEWELRY

BACKGROUND OF THE INVENTION

The present invention is directed toward an improved jewelry clasp or catch with a safety latch which allows the wearer to engage and lock the clasp in a closed position.

Conventional jewelry chains are typically provided with a two-piece clasp which unites the two ends of the chain or bracelet in a clasp mechanism. However, friction between the clasp and the wearer, or other external bodies, frequently causes the clasp mechanism to come undone. With the locking mechanism undone, any additional pressure can cause accidental release of the clasp into its component members and the potential of loss of or damage to the jewelry chain. This problem is often encountered, for example, with baby's bracelets. Friction between the wrist bracelet and the rug, while a baby is crawling, frequently disengages the clasp mechanism securing the bracelet. Further pressure causes the clasp to become undone. The same problem frequently occurs when wrist or neck jewelry chains become entangled with suits, coats, and the like.

It has recently become fashionable for young children to wear jewelry. The desirability of a type of jewelry with the advantages of a clasp mechanism that cannot be readily unlocked and unclasped is readily apparent. Instances of lost jewelry resulting from accidental disengagement of the jewelry chain are numerous. Conventional clasps have design restrictions that prevent or do not address the problems of adequate securement of the opposite ends of the chains. Moreover, those designs which include latch members as a safety backup have often resulted in the unintended disengagement of the latch member followed by unintended disengagement of the clasp, thus resulting in the loss of or damage to valuable jewelry pieces strung along the chain. That is, even conventional designs that use latch members and require two steps—unlocking latch and disengagement of clasp to undo the chain—fall prey to the same accidental disengagement suffered by the one-step clasp. This is caused by the exposed design of the latch mechanism which protrudes from the body of the clasp and thus catches clothing or other external objects.

The present invention provides an improved jewelry clasp which may be incorporated into any jewelry chain, bracelet, or the like and will prevent such accidental disengagement. The improved jewelry clasp satisfies the safety locking requirement while providing a more secure and asthetically pleasing locking engagement then has heretofore been developed.

BRIEF DESCRIPTION OF THE PRIOR ART

Various types of clasps or snaps are disclosed in the prior art. For example, U.S. Pat. No. 917,038 discloses a spring ring snap typically used as part of the conventional jewelry clasp referred to here and above. U.S. Pat. No. 4,024,607 discloses a latch having a hook portion designed to overlay a portion of the wall of the keeper member. U.S. Pat. No. 3,299,679 discloses a dual key clasp having a locking insert which may be removably secured within a casing. The locking insert has a leg and an opposed seat which yielding engage and ear and sawtooth projection, respectively, within the casing. U.S. Pat. No. 1,414,838 shows a casing having apertures in the top and bottom thereof adapted to receive the forward ends of a pair of opposed fork members.

U.S. Pat. No. 3,543,356 discloses a clasp for forming a closed loop from an elongated flexible strand, including a sleeve adapted for receiving a type of compressible latch, wherein the sleeve and latch are secured to space portions of the strand. U.S. Pat. No. 921,846 discloses a chain clasp having tubular male and female members, the male member having a boss which projects through the slot and the female member and engages the forward wall of the slot. U.S. Pat. No. 3,421,341 discloses a plate designed to receive a notched catch having a resilient leg. U.S. Pat. No. 493,188 discloses a harness snap having a tongue member and a tongue receiving member. U.S. Pat. No. 3,793,858 shows a connector having a shaft adapted for engagement with the latching strip. U.S. Pat. No. 2,173,818 discloses a vested and collar holder comprising a rectangular sleeve, the top and bottom of which is provided with a pair of longitudinally aligned slots on a puerility of indents adapted to receive a pair of resilient wire adjusting clips. U.S. Pat. No. 4,590,649 discloses a jewelry catch comprised of a folded pin adapted to be received within a rectangular box for releasable, locking engagement therewith and specifically adapted for stringing jewelry on a jewelry chain and securing opposite ends of the jewelry chain. The folded portion of the pin includes a resilient, angled tab which extends through a opening in the box when the pin is received therein, thereby preventing quotation of the pin within the box and unintentional disengagement of the pin therefrom. The pin may be disengaged from the box by manually deflecting the tab through the box opening and pulling the pin outward from within the box.

Unfortunately, all of the designs suffer from accidental disengagement problems. That is, they are either single step disengagement, or if of the two-step disengagement type (with a latch means for safety locking the clasp) they suffer from accidental disengagement following accidental unlatching.

For example U.S. Pat. No. 1,371,210 discloses a two-member clasp without a locking mechanism. The shank is insertable into a casing. One portion of the shank, made of resilient material, pops into an opening in the casing. However, the opening subjects the shank end to accidental compression and therefore disengagement. Nor does this conventional clasp contain a locking mechanism.

Conventional two-step clasps usually add a ball on one of the two locking members and a folding spring clip on the other. After the locking members of the clasp are engaged, the clip (usually wire) is rotated over the ball. This provides backup insurance to act to prevent potential or accidental disengagement of the locking members. However, the backup locking system is itself subject to easy accidental disengagement, leaving the clasp portion vulnerable, due to protruding of the latch parts which allow hair, clothing, or the like to accidentally catch and release the latch very easily.

The present invention provides a jewelry catch that is esthetically pleasing, eliminates accidental disengagement of the locking members and provides a latch as a backup to accidental disengagement. Moreover, the entire clasp mechanism has smooth, regular sides without any obstructions projecting therefrom.

SUMMARY OF THE INVENTION

It is an object of the present invention to provide an improved jewelry clasp adapted to provide releasable, locking engagement between opposite ends of the jewelry chain.

It is another object of the present invention to provide an improved jewelry clasp which is esthetically pleasing, having flush sides and a regular box shape.

It is still another object of the present invention to provide an improved jewelry clasp which includes a clip adapted to be received within a box for engagement therewith and a safety latch mechanism to secure such engagement.

It is a further object of the present invention to provide an improved jewelry clasp comprising a rectangular box being specifically shaped and having specific size tolerances and a clip member for insertion into the box, the clip having smaller dimensions than the box, to insert into an open end of the box and to engage the box through seating of a boss on the clip in an opening in the box.

It is a still further object of the present invention to provide an improved jewelry clasp comprising a rectangular box having a rectangular opening at the forward end thereof and a rectangular opening in the top thereof, in which a clip member is insertable therein. The clip member is dimensioned to fit within the open end of the rectangular box and contains a boss on the top side thereof dimensioned to fit within the top opening of the box. The clip member locks in place following compression and insertion into the box, by the seating of the boss member in the top opening. A backup locking means is provided by a latch means articulated to pivot from one side of the box and containing a tongue, which when inserted through the side opening of the rectangular box extends between two legs of the clip and prevents compression of the boss.

These and other objects as well are achieved in the present invention, the preferred embodiment of which is described in detail below.

BRIEF DESCRIPTION OF THE PREFERRED EMBODIMENT

Figure 1:
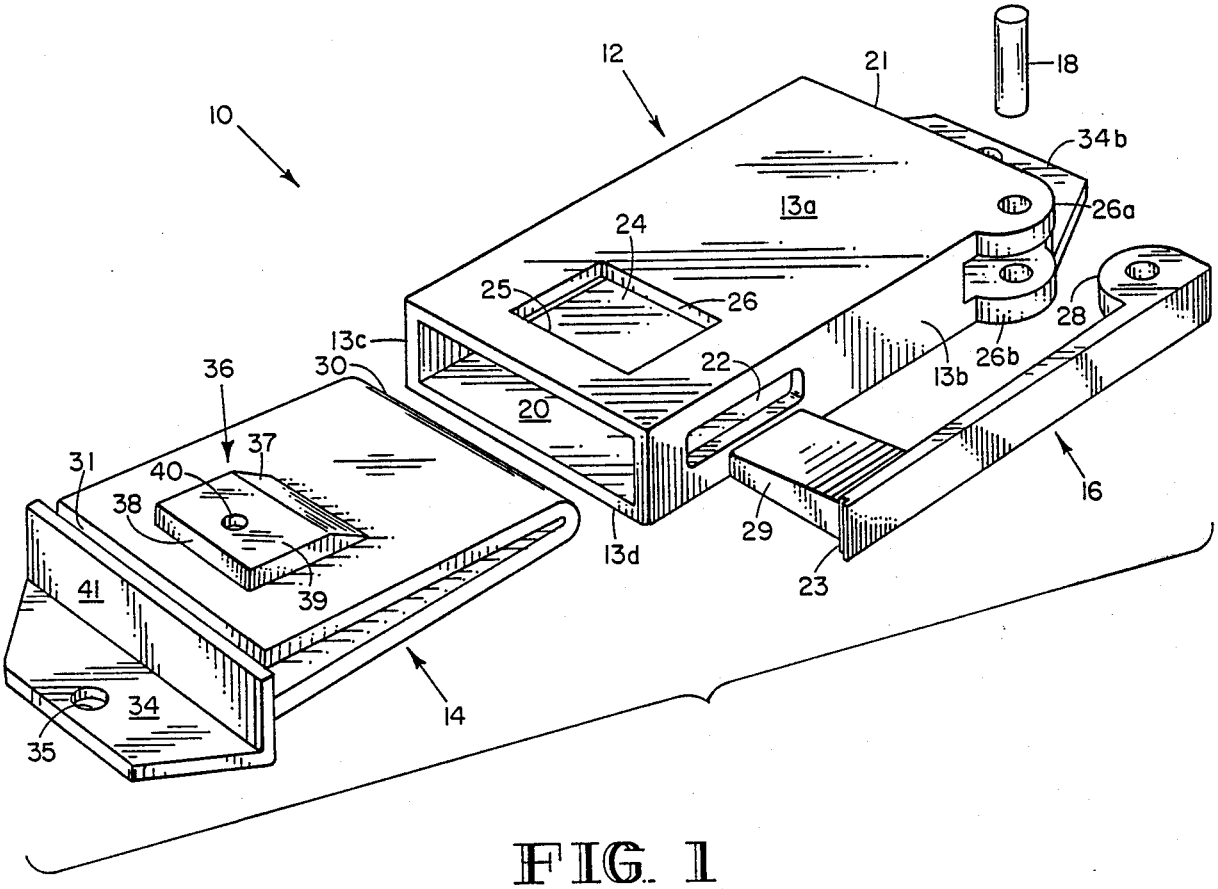
FIG. 1 is an exploded perspective view of the clasp.

FIG. 1 is an exploded perspective of clasp 10 showing the three main components: box 12, clip member 14 and locking pin 16.

Box 12 contains top wall 13*a* with top opening 24 therein. Sidewall 13*b* contains side opening 22 therein. Box 12 also contains sidewall 13*c* and bottom wall 13*d*. The front end of box 12 encloses and defines open front end 20, which is generally rectangular. Rear end 21 of box 12 may be either open or walled, and typically contains jewelry anchor tab 34*b* projecting therefrom. Box 12 is constructed of a rigid material, preferably precious or semi-precious metals such as gold, silver or platinum (or a suitable alloy thereof). At the rear end of sidewall 13*b* are a pair of hinge lobes 26*a* and 26*b* with a space therebetween. As can be seen in FIG. 1, top wall 13*a*, sidewall 13*b*, sidewall 13*c* and bottom wall 13*d* are generally tabular. In the preferred embodiment the exterior dimensions of box 12 are dictated by the size and weight of the jewelry to which box 12 is attached. The bulk of box 12 should not detract from the appearance of the workpiece, yet should be strong enough to retain engagement during normal use.

Top opening 24 of top wall 13*a* is preferably rectangular in shape, located closer to open front end 20 than to rear end 21 of box 12 and preferably is bisected by a longitudinal axes of top wall 13*a*. Top opening 24 contains, at the forward edge thereof, leading edge 25. The dimensions of top opening 24 should not be so great as to compromise the structural integrity of top wall 13*a* nor so small that depression and disengagement of clip member 14 (as set forth in more detail below) is difficult.

Side opening 22 in sidewall 13*b* is preferably rectangular with longitudinal axes thereof preferably coincident with the longitudinal axes of sidewall 13*b*. In addition, side opening 22 is located approximately beneath top opening 24. That is, side opening 22 is approximately the same distance back from open front end 20 as is top opening 24. At the rear end of sidewall 13*b* is located and projects therefrom hinge lobes 26*a* and 26*b*. Hinge pin 18 secures hinge lobes 26*a* and 26*b* to hinge lobe 28. The dimensions of side opening 22 must be sufficient to allow the receipt of locking tongue 29 therein but not so large as to compromise the structural integrity of box 12.

FIG. 1 illustrates locking pin 16, with hinge lobe 28 at one end thereof and locking tongue 29 at the other end. Locking pin shoulder 23 is located at the terminus of locking pin 16. Locking tongue 29 is sized to be removably inserted into side opening 22, and large enough to prevent compression of clip member 14 when clip member 14 is engaged with box 12 as more fully set forth below.

Clip member 14 is also illustrated in FIG. 1. Clip member 14 is sized such that it may be removably inserted through open front end 20, yet is held snugly within box 12 when engaged therewith.

Figure 2:
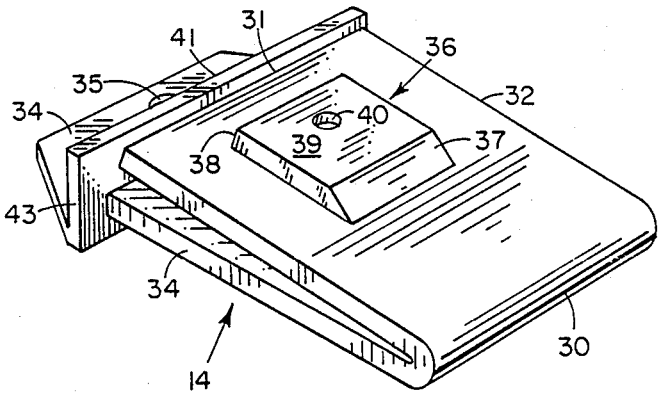
FIG. 2 is a perspective view of the clip member of the box clasp.

FIG. 2 is a perspective showing the shape and components of clip member 14. Clip member 14 is constructed of a tabular, durable and resilient material formed in a "U" shape with apex 30, release leg 32, and anchor leg 34. The material from which clip member 14 is constructed should be sufficiently resilient such that release following manual compression between release leg 32 and anchor leg 34 allows clip member 14 to rebound to its precompressed configuration. Release leg 32 contains locking boss 36 on the top face thereof. Anchor leg 34 contains jewelry anchor point 35 at the foot thereof. Anchor point 35 is typically a hole but may be a male member. At the foot of release leg 32 is end 31.

As can be seen in FIG. 2, locking boss 36 is generally rectangular and dimensional sized just slightly smaller than top opening 24. Locking boss 36 projects above the top face of release leg 32, but is not of sufficient height to project above top wall 13a when clip member 14 is engaged with box 12 (see FIG. 4).

On top surface 39 of locking boss 36 is release indent 40. Leading edge 37 of locking boss 36 is a smooth slope joining top surface 39 with the top face of release leg 32. On the other hand, locking lip 38 drops generally vertical from top surface 39 of locking boss 36 meeting, in a generally perpendicular relation the top face of release leg 32. This perpendicular relation is in contrast to the sloping flow of top surface 39 into release leg 32 as illustrated at leading edge 37. The sloping flow allows easy insertion of clip member 14, through open front end 20 into box 12. The perpendicular locking lip 38 prevents unintended withdrawal once locking boss 36 is seated in top opening 24.

Apex 30 is dimensioned such that it is insertable into open front end 20 of box 12. The "U" configuration of clip member 14 is dimensioned such that upon insertion into box 12, release leg 32 and anchor leg 34 contact the walls defining open front end 20 (walls 13*a*, 13*b*, 13*c*, 13*d*) before locking boss 36 enters top opening 24. Further insertion requires compression of legs 32 and 34, thereby tightening the "U" and insuring that locking boss 36 will pop into top opening 24 when insertion continues. When clip member 14 is fully inserted into box 12, there is still space between legs 32 and 34.

Frontal closure 41 is tabular and dimensioned to seal open front end 20 when clip member 14 is engaged within box 12, with frontal closure shoulder 43 overlapping wall 13*b* so as to protect locking pin shoulder 23 from catching in clothing, hair or the like. When clip member 14 is so engaged and locking boss 36 is seated within top opening 24, release leg 32 is entirely with box 12.

Figure 3:
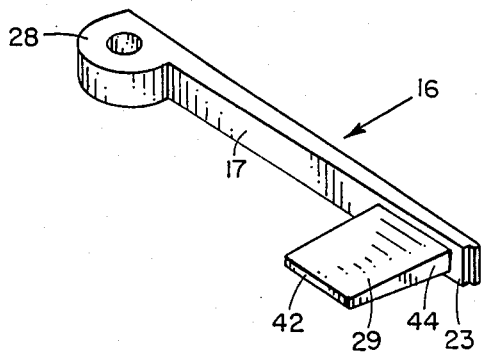
FIG. 3 is a perspective view of the locking pin of the box clasp.

FIG. 3 illustrates a perspective of locking pin 16 removed from clasp 10. Body 17 of locking pin 16 is generally bar-shaped with hinge lobe 28 at one end thereof and locking tongue 29 near the second end thereof. Hinge lobe 28 is dimensioned to fit between hinge lobes 26*a* and 26*b*. Locking pin shoulder 23 extends beyond locking tongue 29. Locking tongue 29 is generally tabular in shape and dimensioned to fit within side opening 22 of sidewall 13*b*. Locking tongue 29 tapers from a thicker trailing edge 44 where it attaches to locking pin 16 to a narrower leading edge 42, for ease of insertion. Such taper may begin at the junction of trailing edge 44 and body 17 or may begin further out towards leading edge 42 (in which case the body of locking tongue 29 will be substantially tabular). The thickness of locking tongue 29 at leading edge 42 should be slightly smaller than the space between legs 32 and 34 when clip member 14 is fully inserted into box 12 with locking boss 36 seated in top opening 24. The thickness of locking tongue 29 at trailing edge 44 should be slightly larger than the space between legs 32 and 34. This allows for ease of insertion of locking tongue 29, yet insures that release leg 32 cannot be depressed and clip member 14 removed while locking pin 16 is in place.

Figure 4:
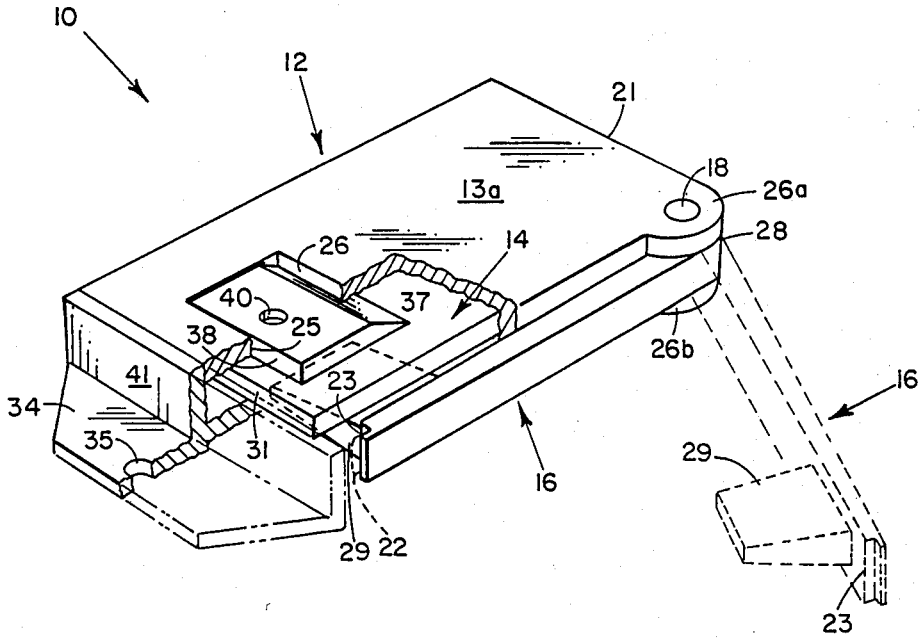
FIG. 4 is a perspective view of the clasp, engaged with clip member and locking pin in place.

FIG. 4 illustrates clasp 10 with clip member 14 engaged and with locking pin 16 in an open position (dashed lines) and in a closed position (solid), but with frontal closure 41 partially removed. Joining box 12 and clip member 14 of clasp 10 requires two steps: engagement, then locking.

First, clip member 14 is inserted, apex 30, first, into open front end 20 of box 12. Clip member 14 is continually urged into open front end 20 until locking boss 36 reaches top opening 24. Release leg 32 and anchor leg 34, having been compressed during insertion, should "pop" or seat locking boss 36 into place within top opening 24 as soon as locking lip 38 passes leading edge 25 of top opening 24. This completes the engagement step.

The second step in uniting clip member 14 to box 12 is the locking step performed by the rotation of locking pin 16 at hinge pin 18 and the insertion of locking tongue 29 into side opening 22. As locking tongue 29 is inserted between release leg 32 and anchor leg 34, its shape and presence will prevent locking boss 36 from depressing. Friction between the surfaces of locking tongue 29, release leg 32 and anchor leg 24 will maintain locking pin 16 in place flush against sidewall 13b, and prevent unintended disengagement. Moreover, frontal closure shoulder 43 will help prevent unintended withdrawal of locking pin 16.

To undo clasp 10, the above two steps are reversed. The first step is unlocking locking pin 16. This is performed by wedging a fingernail beneath locking pin 16 and shoulder 23 and swinging locking pin 16 away from sidewall 13*b* until locking tongue 29 clears side opening 22. The second step is disengagement and requires the depression of release leg 32. A suitable implement (such as a pen or hairpin) may be inserted into release indent 40 and used to depress release leg 32. Such depression should be sufficient to allow locking lip 38 to clear leading edge 25 of top opening 24 and should be followed by pressure along the longitudinal axes of box 12 and directed to remove clip member 14 therefrom. Moreover, the implement used for depression should be applied at an oblique angle to the plane of top wall 13a and pressure applied with a thumb which covers the point of the implement and top wall 13*a*. Such a method will prevent accidental slippage of the implement out of release indent 40, which may occur if pressure is exerted downward by a vertically placed implement.

In an alternate embodiment of clasp 10, double safety latches, being insertable through openings in both sidewalls may be used.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position in which the jewelry clasp may be constructed or used.

Although the invention has been described with reference to a specific embodiment, this description is not meant to be construed in a limiting sense. Modifications of the disclosed embodiments will become apparent to those skilled in the art upon reference to the description of the invention. It is therefore contemplated that the appended claims will cover such modifications that fall within the true scope of the invention.

I claim:

1. A clasp for removably uniting two ends of a jewelry chain, comprising:

a box, with a top wall containing a top opening therein and a bottom wall, a first side wall containing a side opening therein and a second sidewall, and an open front end wherein said box is generally rectangular and the top opening, the side opening, and the open front end of said box are likewise generally rectangular in shape;

a clip, with an apex, a release leg and an anchor leg, the release leg containing a boss thereon, the boss dimensioned to fit within the top opening of said box, said clip for inserting, the apex first, into the open front end of said box until the boss engages the top opening of said box, such engagement thereby securing said clip to said box wherein said clip is folded over at the apex to form a generally "U"-shaped configuration such that during insertion of said clip into the open front end of said box, the release leg and the anchor leg require compression there between for the boss to clear the top wall of said box wherein said clip further contains a frontal closure, located on the anchor leg of said clip and sized such that it is flush with the open end of said box when said clip is fully inserted into said box and engaged therewith, the frontal closure sized such that it overlaps the first side wall for protecting a locking pin from accidental unlocking; and said locking pin including a bar with a first and a second end articulated at the first end thereof to said box and movable in a plane generally parallel to the top wall, and having a locking tongue projecting from the second end of said locking pin, the locking tongue sized to fit within the side opening of said box and between the release leg and the anchor leg of said clip when said clip is inserted into said box, said locking pin for removably placing the locking tongue into said box, said locking pin dimensioned such that when said locking pin is inserted into said box, said locking pin lays flush against the side of said box;

wherein the placing of the locking tongue into the side opening of said box prevents the boss from disengaging from the top opening by preventing compression of the boss and therefore prevents removal of said clip from said box, and the removal of the locking tongue from the side opening of side box allows compression of the boss and therefore disengagement and removal of said clip, and wherein said box, said clip and said locking pin are sized such that when said clip and said locking pin are engaged in said box, the clasp has a substantially smooth exterior, with generally plane, tubular sides.

2. The clasp as described in claim 1 wherein the boss of said clip contains a release indent on a top surface thereof, said release indent shaped to receive a pointed implement, which pointed implement may be used to compress and release said clip from said box, for disengagement therefrom, when the pointed implement is placed in the release indent and pressure is exerted thereon.

3. The clasp as described in claim 1 above wherein a top surface of the boss of said clip contains a smooth, straight leading edge and a generally perpendicular locking lip, such that the smooth leading edge faces the apex of said clip and thereby allows easy insertion into the open end of said box, while the locking lip prevents withdrawal of said clip following seating of the boss within the top opening of said box, unless external pressure is applied to the boss to compress the clip.

4. The clasp as described in claim 1 wherein the side opening of said box is located such that insertion of the locking tongue therein locates the locking tongue generally beneath the top opening of said box.

5. The clasp as described in claim 1 wherein said locking pin further comprises a shoulder at the second end thereof, the shoulder sized for easy access by a fingernail when said locking pin is fully inserted into said box, thereby allowing easy withdrawal of said locking pin from said box.

6. The clasp as described in claim 1 wherein said clip includes a first jewelry anchor point on the anchor leg thereof, such first jewelry anchor point adapted to receive a first end of a jewelry chain thereon, and wherein said box includes a second jewelry anchor point located at a rear end thereof, for receiving a second end of the jewelry chain.

7. The clasp as described in claim 1 wherein said box further includes articulation means on the first sidewall thereof, the articulation means for receiving said locking pin and allowing said locking pin to pivotally rotate.

8. The clasp as described in claim 7 wherein the articulation means of said box is a hinge from which the first end of said locking pin articulates.

9. The clasp as described in claim 1 wherein the locking tongue of said locking pin is generally rectangular and tabular in shape, with a leading edge and a trailing edge, the leading edge being wedge shaped and the first portion of the locking tongue to enter the side opening and the first side wall, and the trailing edge being the portion of the locking tongue where the locking tongue attaches to said locking pin, the trailing edge being thicker than the leading edge and sufficiently thick to prevent the locking means of said clip from compressing when said locking pin is fully inserted into the side opening of the first side wall of said box.

10. A clasp for removably uniting two ends of a jewelry chain, comprising:

a box, rectangular in shape with a top wall containing a generally rectangular top opening therein and a bottom wall, a smooth first sidewall containing a generally rectangular side opening therein and a smooth second sidewall, and a generally rectangular open front end, and also having a smooth rear end with a jewelry chain anchor point attached thereto;

a clip, formed in a generally "U" configuration and made of a resilient metal, with the "U" configuration of said clip hereby forming an apex, a release leg and an anchor leg, the release leg containing a boss projecting from a top surface thereof, the boss dimensioned to fit flush within the top opening of said box and containing a release indent therein, and the anchor leg containing a jewelry anchor point at a foot thereof, and also including a frontal closure dimensioned to fit flush against and seal the open front end of said box when said clip is fully inserted therein and the boss is seated in the top opening of the top wall of said box;

a locking pin including a generally tabular bar with a first and a second end; articulated at the first end thereof on the first side wall of said box near the rear end thereof, and having a shoulder on the second end thereof, said locking pin articulated to move in a plane generally parallel to the top wall of said box, said locking pin also having a generally rectangular locking tongue, generally wedge shaped, projecting from the second end therefrom, and dimensioned to be insertable, narrow edge first, into the side opening of the first side wall of said box, such that when said clip is engaged in said box, with the boss of said clip seated in the top opening of the top wall of said box, said locking pin can be insertably removed. into said box and between the release leg and the anchor leg of said clip, the wedge shape of the locking tongue preventing the boss on the release leg from compressing when said locking pin is inserted, with the bar of said locking pin laying flush against the first side wall of said box resulting in the clasp appearing generally smooth sided when engaged and when said locking pin is inserted into the side opening of the side wall.

* * * * *